US005439311A

United States Patent [19]

Hughes, Jr.

[11] Patent Number: 5,439,311

[45] Date of Patent: Aug. 8, 1995

[54] BENDABLE MARKER WITH RIBBED SLEEVE

[75] Inventor: Robert K. Hughes, Jr., Fort Myers, Fla.

[73] Assignee: Flexstake, Inc., Fort Myers, Fla.

[21] Appl. No.: 169,476

[22] Filed: Dec. 17, 1993

[51] Int. Cl.[6] ..... E01F 9/017

[52] U.S. Cl. ..... 404/10; 40/608; 40/612; 248/548; 248/900; 403/223

[58] Field of Search ..... 404/10, 11, 13, 6, 9, 404/14; 40/608, 612; 116/63 R; 248/156, 160, 548, 900; 52/98-99; 403/223

[56] References Cited

U.S. PATENT DOCUMENTS

| | | | |
|---|---|---|---|
| 1,599,066 | 9/1926 | Rushmore | 40/608 |
| 1,726,817 | 9/1929 | Franklin . | |
| 2,719,214 | 9/1955 | Potter . | |
| 3,974,372 | 8/1976 | Cochran | 52/98 X |
| 4,249,357 | 2/1981 | Cornou | 404/13 X |
| 4,564,309 | 1/1986 | Bjorlund . | |
| 4,611,949 | 9/1986 | Schmanski . | |
| 4,636,109 | 1/1987 | Clausen et al. . | |
| 5,040,478 | 8/1991 | Hughes . | |
| 5,205,236 | 4/1993 | Hughes . | |

*Primary Examiner*—Ramon S. Britts
*Assistant Examiner*—James A. Lisehora
*Attorney, Agent, or Firm*—Grady K. Bergen

[57] ABSTRACT

A bendable marker for use in areas where the marker is required to be flexible is provided with a base and a marker post which are joined together by a flexible sleeve. The flexible sleeve has a plurality of evenly spaced ribs which extend longitudinally along the sleeve from an upper end to a lower end. The ribs are evenly spaced apart with a groove being formed between each of the ribs. The ribs protrude from both the inner and outer surfaces of the flexible sleeve. If the marker post is struck, the flexible sleeve allows the marker post to bend relative to the base. The ribs strengthen and enhance the resiliency of the sleeve.

19 Claims, 2 Drawing Sheets

BENDABLE MARKER WITH RIBBED SLEEVE

BACKGROUND OF THE INVENTION

1. Field of the Invention

This invention relates to a marker having a flexible element which allows the marker to bend.

2. Description of the Prior Art

Markers are often used along roadsides or areas where there is a potential that the marker will be hit by passing objects, such as automobiles. When the markers are hit, the markers are often damaged and must eventually be replaced. To help minimize the damage to these markers, these markers are often constructed to be flexible so that when the marker is struck, the marker bends or flexes and thereby sustains little if any damage. This also helps prevent damage to the automobile or object which strikes the marker. Flexible markers may have a flexible element, such as a spring or elastomeric sleeve, which allows the marker to bend. The flexible element also restores the marker to its original position.

SUMMARY OF THE INVENTION

The bendable marker of the invention has a base with an upward protruding mandrel and a marker post. A flexible, elastomeric sleeve having a longitudinal axis extending from the upper end of the flexible sleeve joins the base and marker post. The lower end of the sleeve is mounted over and secured to the mandrel of the base, and the upper end is secured to the marker post. Located about the midsection of the flexible sleeve are a plurality of longitudinally extending ribs formed in the flexible sleeve. The ribs are located on both the inner and outer surface of the sleeve and enhance the resiliency of the flexible sleeve.

DETAILED DESCRIPTION OF THE INVENTION

Figure 1:
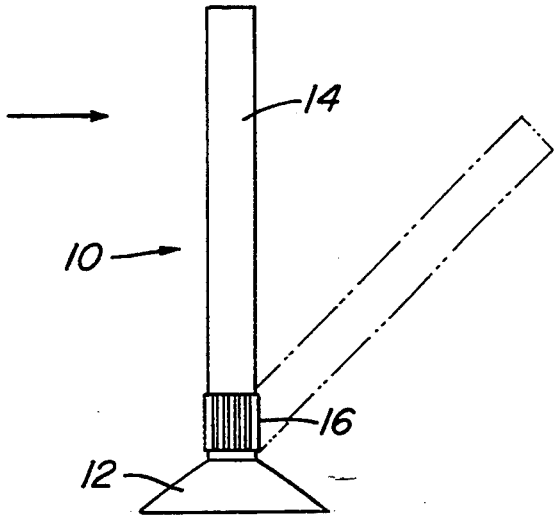
FIG. 1 is a side view of a bendable marker constructed in accordance with the invention.
Figure 2:
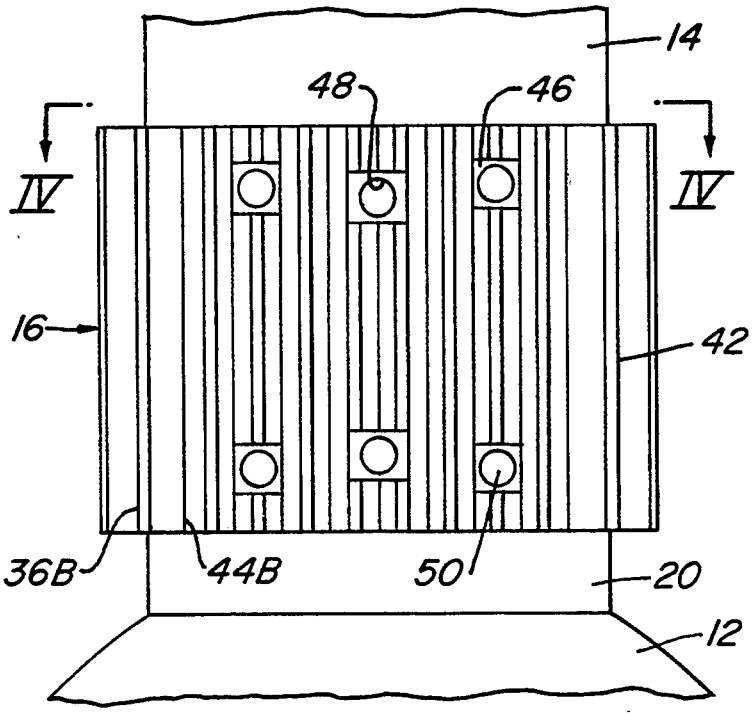
FIG. 2 is a side view of a flexible element of the bendable marker of FIG. 1 which is constructed in accordance with the invention.
Figure 3:
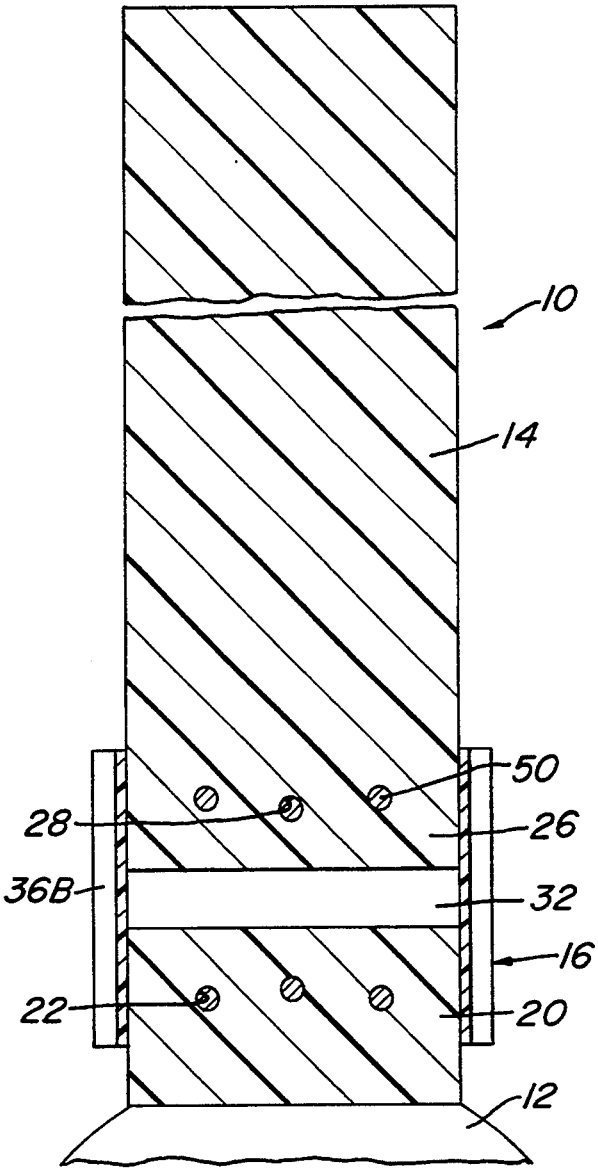
FIG. 3 is a cross-sectional side view of the bendable marker constructed in accordance with the invention.

Referring to the figures, FIG. 1 shows a bendable marker 10 having a base 12 and a marker post 14 which is joined to the base 12 by means of an elastomeric, flexible sleeve 16. The base 12 is formed with an upwardly protruding mandrel 20, as shown in FIGS. 2 and 3. The mandrel 20 is provided with holes 22 which extend through the mandrel 20.

The marker post 14 is a substantially rigid member having a lower end which serves as a mounting portion 26. The mounting portion 26 is inserted into the upper end of the flexible sleeve 16. The lower end 26 of the mounting post 14 is provided with holes 28 which extend through the thickness of the marker post 14 through the mounting portion 26. The upper end of the flexible sleeve 16 surrounds the mounting portion 26 of the marker post 14, while the lower end of the flexible sleeve 16 mounts over and surrounds the protruding mandrel 20 of the base 12.

As can be seen in FIG. 3, the lower end of the marker post 14 and the upper end of the mandrel 20 are spaced apart to form a gap or clearance 32. This allows the marker post 14 to bend relative to the base 12.

Figure 4:
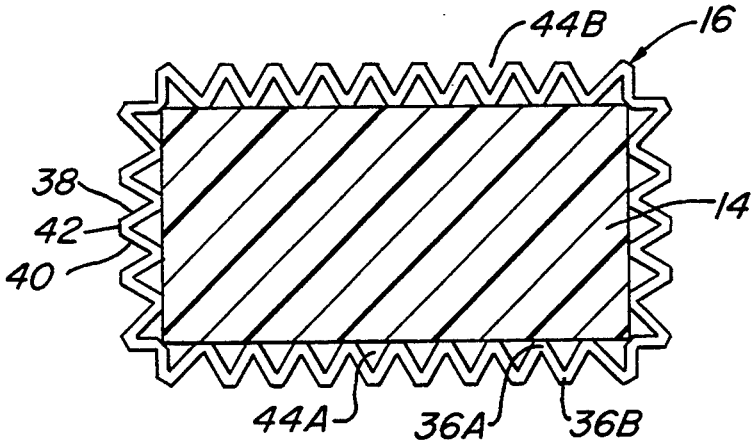
FIG. 4 is a cross sectional view of the bendable marker of FIG. 2 taken along the lines IV—IV.

The flexible sleeve 16 is substantially rectangular in cross section, in the embodiment of FIG. 4, and is formed from a single piece of resilient, molded polyurethane or other elastomeric material. Two sides of the rectangular sleeve 16 are about twice the dimension of the other two sides. The flexible sleeve 16 is formed as a continuous wall with inner and outer ribs 36A, 36B protruding from the interior and exterior surfaces, respectively, of the sleeve 16. The ribs 36A, 36B extend longitudinally from the upper end of the sleeve 16 to the lower end of the sleeve 16. Each of the ribs 36A, 36B has longitudinally extending, converging sidewalls 38, 40 which converge from a base of the ribs 36A, 36B toward a peak 42 formed on the outermost extremity of each rib 36A, 36B.

Each of the inner ribs 36A on the inner surface of the sleeve 16 is evenly spaced apart from adjacent inner ribs 36A to form a longitudinally extending inner groove 44A between each inner rib 36A which is defined by the sidewalls 38, 40 of adjacent inner ribs 36A. The inner ribs 36A and grooves 44A are evenly spaced apart and extend circumferentially around the inner surface of the sleeve 16. Likewise, the outer ribs 36B on the outer surface of the sleeve 16 are evenly spaced apart from adjacent outer ribs 36B to form longitudinally extending outer grooves 44B between each outer rib 36B. The outer ribs 36B and outer grooves 44B are also evenly spaced apart and extend circumferentially around the outer surface of the sleeve 16.

The inner and outer ribs 36A, 36B and grooves 44A, 44B each have substantially triangular cross sections with the width of the ribs 36A, 36B and the grooves 44A, 44B being the same. As shown in FIG. 4, the outer ribs 36B are circumferentially staggered from the inner ribs 36A approximately a distance equal to one half the width of the ribs 36A, 36B with the outer grooves 44B corresponding with the inner ribs 36A. Likewise, the inner grooves 44A correspond with the outer ribs 36B. The ribs 36A, 36B and grooves 44A, 44B create a corrugated cross section of the continuous wall which forms the flexible sleeve 16.

Located on the exterior of the flexible sleeve 16 at the upper and lower ends are flat portions 46 cut into the ribs 36B formed on the exterior of the sleeve 16. Holes 48 located in the flat portions 46 and extending through the thickness of the sleeve 16 are oriented to align with the holes 22, 28 of the upward protruding mandrel 20 and mounting portion 26, respectively. Fasteners 50, preferably rivets, extend through the holes 48 of the sleeve 16 and the holes 22, 28 of the mandrel 20 and mounting portion 26, thereby joining the flexible sleeve 16 to the marker post 14 and base 12.

As shown in FIG. 4, when the flexible sleeve 16 is mounted to the base 12 and marker post 14, the ribs 36A formed on the interior of the sleeve 16 contact the mounting portion 26 of the marker post 14, as well as the mandrel 20 of the base 12. The mounting portion 26 and the mandrel 20 are smooth rectangular members and do not have corrugations or grooves.

The flexible sleeve 16 allows the marker post 14, which is stiff or rigid, to bend relative to the base 12 from a first position to a second position, as shown by the broken lines in FIG. 1, when subjected to an outside force as indicated by the arrow of FIG. 1. The longitudinally extending ribs 36A, 36B improve the resiliency of the flexible element 16 and minimize the amount of polyurethane or elastomeric material necessary to form the sleeve 16. It should be noted that the flexible sleeve 16 does not have to be rectangular as shown in FIG. 4, but could be formed in a variety of shapes.

Figure 6:
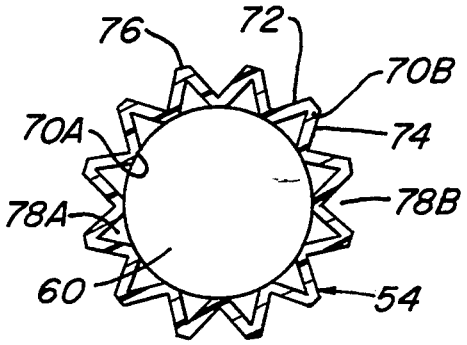
FIG. 6 is a cross-sectional view of the flexible element of the bendable marker of FIG. 5 taken along the lines VI—VI.
Figure 5:
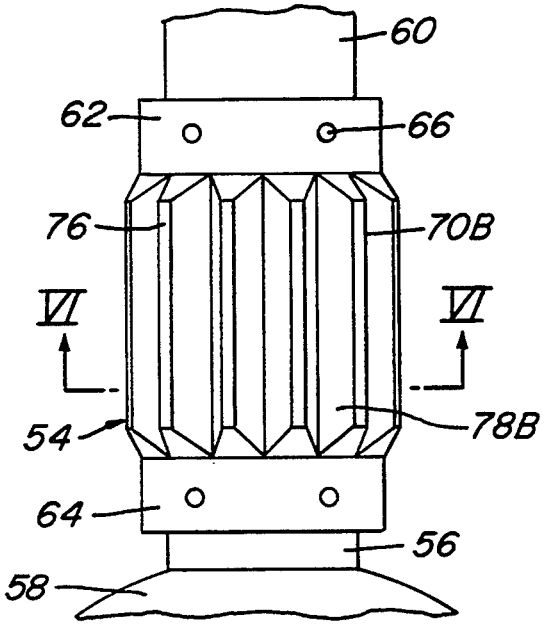
FIG. 5 is another embodiment of the bendable marker constructed in accordance with the invention.

FIGS. 5 and 6 show another embodiment of the invention. As shown in FIG. 5, a flexible sleeve 54 is disposed between an upward protruding mandrel 56 of a base 58 and a marker post 60. The mandrel 56 and lower portion of the marker post 60 each have a circular cross section. The flexible sleeve 54 is similar to the flexible sleeve 16 of FIGS. 14, however, the sleeve 56 has an upper and lower end 62, 64 which are free of ribs. The upper and lower ends 62, 64 are joined to the mandrel 56 and the lower end or mounting portion of the marker post 60 by rivets 66 or fasteners.

Inner and outer ribs 70A, 70B are formed only on the midsection of the sleeve 54 and are similar to the ribs of the sleeve 16 of FIGS. 14. Each of the ribs 70A, 70B has inclined sidewalls 72, 74, which are inclined from the base of the ribs 70A, 70B toward a peak 76 located on the outer extremity of the ribs 70A, 70B. Each of the inner ribs 70A on the inner surface of the sleeve 54 is evenly spaced apart from adjacent inner ribs 70A to form a longitudinally extending inner gap or groove 78A between each inner rib 70A. Each inner groove 78A is defined by the sidewalls 72, 74 of adjacent inner ribs 70A. The inner ribs 70A and grooves 78A are evenly spaced apart and extend circumferentially around the inner surface of the sleeve 54. The outer ribs 70B on the outer surface of the sleeve 54 are also evenly spaced apart from adjacent outer ribs 70B to form longitudinally extending outer grooves 78B between each outer rib 70B. The outer ribs 70B and outer grooves 78B are also evenly spaced apart and extend circumferentially around the outer surface of the sleeve 54.

The grooves 78A, 78B and ribs 70A, 70B each have a triangular cross section perpendicular to the longitudinal axis of the sleeve 54 causing the wall of the sleeve 54 to have a corrugated cross section. As shown in FIG. 6, the sleeve 54 itself has a substantially circular cross section which corresponds to the circular cross section of the mandrel 56 and lower end of the marker post 60.

The bendable marker of the invention has several advantages. Because the flexible sleeve is ribbed and provided with grooves, the marker post of the invention is more resilient when subjected to deformation. The longitudinally extending ribs allow the flexible sleeve to have thinner walls while still providing substantial structural rigidity. The ribbed sleeve requires less polyurethane or elastomeric material to be used to provide the same resiliency and strength as a flexible sleeve which has no ribs.

While the invention has been shown in only one of its forms, it should be apparent to those skilled in the art that it is not so limited, but is susceptible to changes in variations without departing from the scope of the invention.

I claim:

1. A bendable marker comprising in combination:

a base;

a marker post; and an elastomeric flexible element having a longitudinal axis extending from an upper end to a lower end of the flexible element, the lower end of the flexible element being secured to the base and the upper end being secured to the marker post, the flexible element having a midsection located between the upper end and the lower end of the flexible element, the midsection having a plurality of longitudinally extending ribs formed therein which are separated by longitudinally extending grooves located about the midsection of the flexible element, the grooves defining void spaces which are free of material when the flexible element is secured to the base and marker post, the ribs enhancing the resiliency of the flexible element when the marker post is bent relative to the base.

2. The bendable marker of claim 1, wherein:

the ribs protrude outward from an exterior surface of the midsection of the flexible element.

3. The bendable marker of claim 1, wherein:

the elastomeric flexible element is a hollow sleeve having a lower end and an upper end;

the base has an upward extending mandrel;

the marker post has a mounting portion on the lower end of the marker post;

the lower end of the sleeve extends over the mandrel; and the upper end of the sleeve extends over the mounting portion of the marker post.

4. The bendable marker of claim 1, wherein:

the ribs are spaced evenly apart from each other around the elastomeric member.

5. The bendable marker of claim 1, wherein:

each of the grooves is triangular in cross section.

6. In a bendable marker having a base with a mandrel, a marker post having a lower end containing a mounting portion, and a hollow, elastomeric flexible sleeve having a longitudinal axis extending from an upper end of the sleeve to a lower end of the sleeve, the lower end of the sleeve mounting over and being secured to the mandrel and the upper end of the sleeve mounting over and being secured to the mounting portion of the market post, the flexible sleeve having a midsection located between the upper end and the lower end of the sleeve, the improvement comprising:

a plurality of longitudinally extending ribs located on an inner surface of the midsection of the elastomeric sleeve which are separated by longitudinally extending inner grooves, the inner grooves defining void spaces which are free of material when the flexible element is secured to the base and marker post; and a plurality of longitudinally extending ribs located on an outer surface of the midsection of the elastomeric sleeve, the ribs enhancing the resiliency of the flexible sleeve when the marker post is bent relative to the base.

7. The bendable marker of claim 6, wherein:

the outer ribs are separated by longitudinally extending outer grooves located about the midsection of the flexible element.

8. The bendable marker of claim 7, wherein:

each of the grooves is triangular in cross section.

9. The bendable marker of claim 6, wherein:

the ribs are spaced evenly apart from each other around the elastomeric sleeve.

10. The bendable marker of claim 6, wherein:

the longitudinally extending ribs on the inner surface and the outer surface extend along the entire length of the flexible sleeve from the upper end of the sleeve to the lower end of the sleeve.

11. In a bendable marker having a base with a mandrel, a marker post having a lower end containing a mounting portion, and a hollow, elastomeric flexible sleeve having a longitudinal axis extending from an upper end of the sleeve to a lower end of the sleeve, the lower end of the sleeve mounting over and being secured to the mandrel and the upper end of the sleeve mounting over and being secured to the mounting portion of the marker post, the flexible sleeve having a midsection located between the upper end and the lower end of the sleeve, the improvement comprising:

a plurality of longitudinally extending inner ribs located on an inner surface of the midsection of the elastomeric sleeve, each of the inner ribs being circumferentially evenly spaced apart from adjacent inner ribs by longitudinally extending inner grooves, the inner grooves defining void spaces which are free of material when the flexible element is secured to the base and marker post; and a plurality of longitudinally extending outer ribs located on an outer surface of the midsection of the elastomeric sleeve, each of the outer ribs being circumferentially evenly spaced apart from adjacent outer ribs by longitudinally extending outer grooves; and wherein the inner and outer ribs are positioned to define a corrugated cross section for the midsection of the sleeve, the inner and outer ribs enhancing the resiliency of the flexible element when the marker post is bent relative to the base.

12. The bendable marker of claim 11, wherein:

the ribs extend along the entire length of the flexible sleeve from the upper end to the lower end of the sleeve.

13. The bendable marker of claim 11, wherein: each of the grooves is triangular in cross section.

14. The bendable marker of claim 11, wherein:

the sleeve is substantially cylindrical in shape.

15. The bendable marker of claim 11, wherein:

the sleeve is rectangular in cross section.

16. The bendable marker of claim 11, wherein:

the ribs extend only the length of the midsection.

17. The bendable marker of claim 11, wherein:

the width of each of the ribs is the same as the width of each of the grooves.

18. In a bendable marker having a base with a mandrel, a marker post having a lower end containing a mounting portion, and a hollow, elastomeric flexible sleeve having a longitudinal axis extending from an upper end of the sleeve to a lower end of the sleeve, the lower end of the sleeve mounting over and being secured to the mandrel and the upper end of the sleeve mounting over and being secured to the mounting portion of the marker post, the flexible sleeve having a midsection located between the upper end and the lower end of the sleeve, the improvement comprising:

a plurality of longitudinally extending inner ribs located on an inner surface of the midsection of the elastomeric sleeve, each of the inner ribs being circumferentially evenly spaced apart from adjacent inner ribs by longitudinally extending inner grooves; and a plurality of longitudinally extending outer ribs located on an outer surface of the midsection of the elastomeric sleeve, each of the outer ribs being circumferentially evenly spaced apart from adjacent outer ribs by longitudinally extending outer grooves; wherein the inner and outer ribs are positioned to define a corrugated cross section for the midsection of the sleeve, the inner and outer ribs enhancing the resiliency of the flexible element when the marker post is bent relative to the base; and the ribs extend only the length of the midsection.

19. In a bendable marker having a base with a mandrel, a marker post having a lower end containing a mounting portion, and a hollow, elastomeric flexible sleeve having a longitudinal axis extending from an upper end of the sleeve to a lower end of the sleeve, the lower end of the sleeve mounting over and being secured to the mandrel and the upper end of the sleeve mounting over and being secured to the mounting portion of the marker post, the flexible sleeve having a midsection located between the upper end and the lower end of the sleeve, the improvement comprising:

a plurality of longitudinally extending inner ribs located on an inner surface of the midsection of the elastomeric sleeve, each of the inner ribs being circumferentially evenly spaced apart from adjacent inner ribs by longitudinally extending inner grooves; and a plurality of longitudinally extending outer ribs located on an outer surface of the midsection of the elastomeric sleeve, each of the outer ribs being circumferentially evenly spaced apart from adjacent outer ribs by longitudinally extending outer grooves with the inner grooves being located inwardly adjacent to the outer ribs; wherein the inner and outer ribs are positioned to define a corrugated cross section for the midsection of the sleeve, the inner and outer ribs enhancing the resiliency of the flexible element when the marker post is bent relative to the base; and the ribs extend along the entire length of the flexible sleeve from the upper end to the lower end of the sleeve, the inner ribs being adapted to contact the mandrel and the mounting portion with the inner grooves defining a void space between the elastomeric sleeve and the mandrel and between the elastomeric sleeve and the mounting portion.

* * * * *